United States Patent [19]

Oliver et al.

[11] 4,241,976

[45] Dec. 30, 1980

[54] CONTACT RETENTION CLIP AND METHOD OF INSERTING SAME IN AN INSULATOR

[75] Inventors: Leland W. Oliver; John R. Moore, both of Santa Ana; Peter S. Willcox, Costa Mesa; James L. von Harz, South Laguna; Robert J. Trivison, Newport Beach, all of Calif.

[73] Assignee: International Telephone and Telegraph Corporation, New York, N.Y.

[21] Appl. No.: 59,311

[22] Filed: Jul. 20, 1979

[51] Int. Cl.[3] ..... H01R 13/405

[52] U.S. Cl. ..... 339/278 D; 29/458; 29/523; 29/882; 29/883; 339/218 R

[58] Field of Search ..... 339/218, 278 D; 29/629, 29/469.5, 522, 523, 458, 882, 883; 264/249

[56] References Cited

U.S. PATENT DOCUMENTS

| | | | |
|---|---|---|---|
| 2,443,513 | 6/1948 | Quackenbush | 339/218 R |
| 2,718,485 | 9/1955 | Samuely | 29/458 |
| 3,061,503 | 10/1962 | Gould et al. | 339/218 R |
| 4,114,976 | 9/1978 | Selvin et al. | 339/218 M |

OTHER PUBLICATIONS

Electronics; pp. 130–132; "Resins for Embedding" by C. A. Karper; Feb. 17, 1961.

*Primary Examiner*—John McQuade
*Attorney, Agent, or Firm*—Thomas L. Peterson

[57] ABSTRACT

A contact retention clip is provided with a B-stage epoxy resin coating. The clip is installed in the contact cavity of a plastic body under heat and pressure to cause the coating to form its final resin. The resin becomes impregnated into the wall of the cavity to seal micro cracks in the wall which otherwise may lead to voltage breakdowns.

9 Claims, 8 Drawing Figures

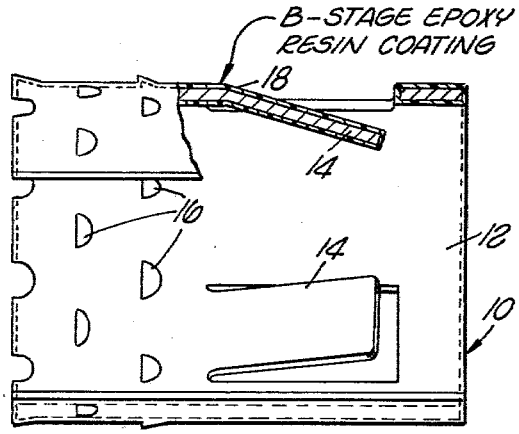
FIG. 1
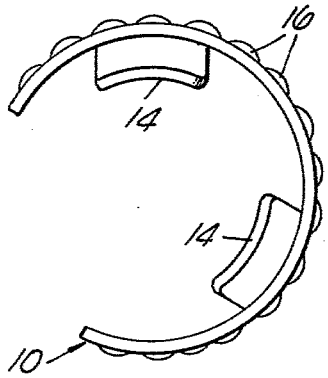
FIG. 2
FIG. 3
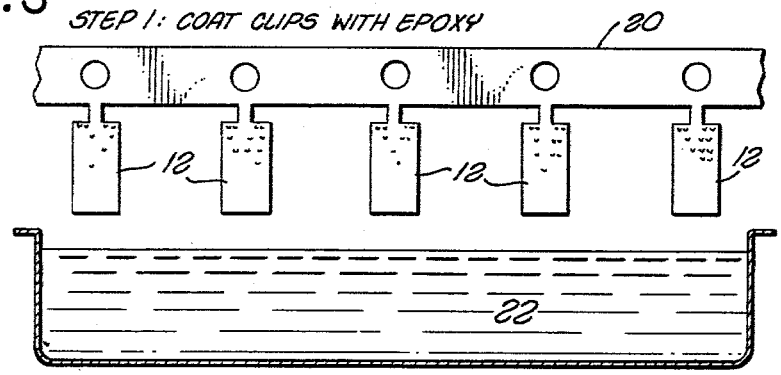
FIG. 4
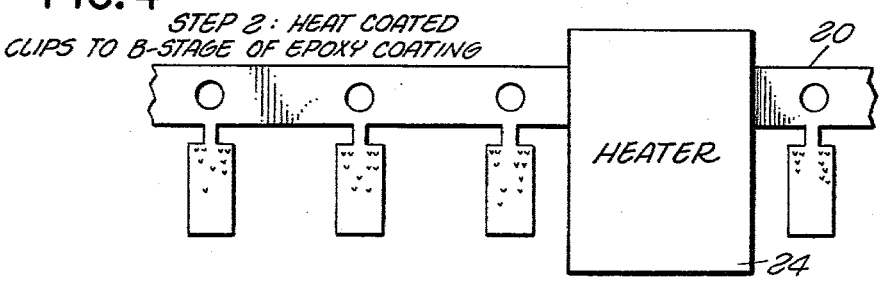

STEP 3:
INSTALL INDIVIDUAL CLIP IN CONTACT CAVITY.

STEP 4:
INSERT HEATED PROBE INTO CLIP.

STEP 5:
EMBED BARBS UNDER HEAT AND PRESSURE INTO PLASTIC AND SEAL CRACKS IN WALL OF CAVITY.

STEP 6:
REMOVE PROBE FROM CLIP.

CONTACT RETENTION CLIP AND METHOD OF INSERTING SAME IN AN INSULATOR

BACKGROUND OF THE INVENTION

This invention relates generally to the electrical connector art and, more particularly, to a contact retention clip and a method of installing the same in the insulator of an electrical connector.

U.S. Pat. No. 4,114,976 to Selvin et al., assigned to the assignee of the present application, discloses a contact retention clip having outwardly extending barbs thereon. After the clip is inserted into a contact cavity in a connector insulator, a heated probe is inserted into the clip to soften the wall of the insulator surrounding the clip, and to expand the clip causing the barbs thereon to become embedded into the softened wall. The embedded barbs enhance the retention of the clip in the connector cavity.

As stated in the aforementioned Selvin et al. patent, a particular material which may be utilized as the insulator for the connector is a polysulfone type polymer. A preferred polymer of this type is a polyethersulfone. Problems are occasionally encountered in the use of such material as the insulator of an electrical connector in that micro cracks may occur in the insulator due to stresses during molding or during post baking of the insulator. When the contact cavities in the insulator are closely spaced, the thickness of the plastic will between the cavities may be only 9 to 11 mils. With such thin walls, occasionally the micro cracks in the plastic will extend from one cavity to the other, resulting in voltage breakdowns between adjacent contacts when sufficiently high current passes through the connector. In addition, if the connector is subjected to moisture, water may become loaded into the cracks between the contact cavities, which further leads to voltage breakdowns between the cavities. The foregoing problem may occur when using other plastic materials as connector insulators.

We have attempted to overcome the problem of stress cracks in the walls of the contact cavities by impregnating the cavities with an epoxy and other resin to seal the cracks but without success. Accordingly, the purpose of the present invention is to provide some means for sealing micro cracks which may exist in a connector insulator in order to prevent, or at least minimize, the possibility of voltage breakdown between adjacent contact cavities.

SUMMARY OF THE INVENTION

According to a principal aspect of the present invention, there is provided a method of making an electrical connector assembly comprising the steps of providing a plastic body having a bore therein, and providing a contact retention clip having a resinous coating thereon. The clip is inserted in the bore and the coating thereon is heated to cause any cracks which may exist in the wall of the bore to become sealed by the coating.

According to another aspect of the invention, there is provided a contact retention clip adapted to be mounted in the bore of a plastic connector body. The clip comprises a hollow metallic body having an inwardly extending resilient contact retention tine thereon. A B-stage resinous coating is provided on the metallic body so that when the clip is inserted in the bore and heated, the coating thereon will seal any cracks which might exist in the wall of the bore.

BRIEF DESCRIPTION OF THE DRAWINGS

FIG. 1 is a partial longitudinal sectional view through the epoxy coated contact retention clip of the present invention;

FIG. 2 is a right-end elevational view of the contact retention clip illustrated in FIG. 1;

FIGS. 3 and 4 are schematic illustrations showing two steps in the coating of a string of contact retention clips in accordance with the present invention.

DESCRIPTION OF THE PREFERRED EMBODIMENTS

Figure 5:
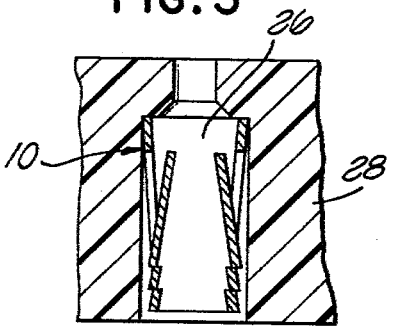
FIGS. 5 to 8 are broken away vertical sectional views of a connector insulator and a clip similar to that shown in FIGS. 1 and 2 illustrating the steps which may be performed in accordance with the invention to install the clip in a fixed position in a contact cavity of the insulator.

Reference is now made to FIGS. 1 and 2 of the drawings in detail which illustrate a coated contact retention clip in accordance with the present invention, generally designated 10. The clip comprises a generally cylindrical metal body 12 formed with a pair of resilient inwardly extending contact retention tines 14. Outwardly extending barbs 16 are stamped out of the body 12. A coating 18 covers the body. The coating is formed of a material which is capable of sealing any micro cracks which may exist in the wall of a contact cavity of a plastic connector insulator into which the clip is intended to be installed. Thus, the contact retention clip 10 may be basically the same as that disclosed in the aforementioned Selvin et al. patent except for the addition of the coating 18.

For the coating 18 to be capable of filling micro cracks in the plastic insulator, it is necessary that the coating be formed of a material which is compatible with the material of the insulator, that is, will become impregnated into the insulator. Preferably, the coating is formed of a resinous material which contains a chemical substituent common with a chemical substituent in the plastic insulator.

In a preferred embodiment of the invention, the connector insulator is a polyethersulfone. A suitable coating material which is compatible with such plastic is a sulfone modified epoxy resin system such as ED-2290 structural adhesive marketed by 3M. Based upon an infrared analysis of this material, we believe that the adhesive is an epoxy resin which has been reacted with a sulfone monomer, such as, 4,4'-sulfonyldiphenol.

The EC-2290 adhesive is described by its manufacturer as being a thermosetting liquid structural adhesive for bonding metal to metal or for production of copper-clad epoxy glass laminates. It has the following physical properties:

color—light amber
consistency—thin syrup
solids content—21 ±1% by weight
base—epoxy resin
solvent—ketone-alcohol
net weight—7.5±0.2 lbs./gal.
flash point—24° F. (COC)

In order to coat a contact retention clip with EC-2290 resin, it is preferable to reduce the solid content by mixing it with a suitable solvent, such as methylethylketone. To properly coat a clip formed of beryllium copper, preferably sufficient solvent is added to the original epoxy resin to reduce its solid content to 6%.

A contact retention clip may be coated by providing a plurality of clip bodies 12 attached to a carrier strip 20 as illustrated in FIG. 3. The strip 20 is lowered to immerse the clips 12 into a body of the diluted epoxy resin 22 as hereinbefore described. The clips are thereafter removed from the solution and passed through an air knife (not shown) to blow excess epoxy solution away. The carrier strip with the coated clips 12 then passes through a heater 24, as illustrated in FIG. 4, to B-stage the epoxy resin. The diluted EC-2290 epoxy resin coating is preferably heated to about 250° F. to cause it to be B-staged, that is, not completely cross-linked, but dried and hardened so that the string of coated clips may be handled and stored conveniently. Preferably, the epoxy coating has a thickness of about 0.1 to 0.3 mils.

Figure 6:
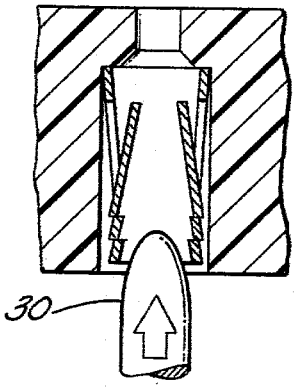
Figure 7:
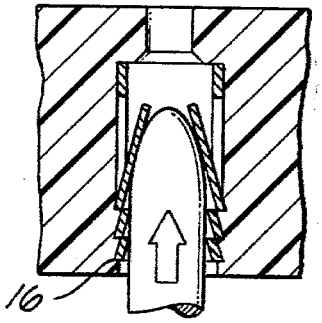
Figure 8:
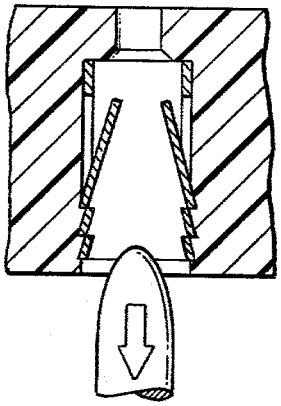

FIGS. 5 to 8 depict the steps required to install an individual coated contact retention clip into a contact cavity 26 in the plastic body 28 of a connector. A coated clip 10, which has been removed from the carrier strip 20, is first inserted into the cavity 26 by initially contracting the clip and inserting it upwardly into the cavity. Thereafter, a heated, tapered probe 30 is inserted into the rear of the clip, as shown in FIG. 6, thereby heating the clip and causing it to expand. Preferably, the probe is heated to approximately 500° F. Heating of the probe, and thus the clip, causes the plastic material of the body 28 surrounding the clip to soften, thereby allowing the barbs 16 on the clip to become embedded into the wall of the contact cavity as illustrated in FIG. 7. This heating operation also causes the B-stage epoxy resin coating 18 on the clip to cross-link and polymerize to form its final resin. Since the clip is under pressure by the probe 13 during this process, the resin coating on the clip permeates into the micro cracks in the wall of the contact cavity, thereby sealing the same. Thereafter, the probe 30 is withdrawn from the clip as illustrated in FIG. 8.

We have sectioned a plastic body having an epoxy resin coated contact retention clip installed therein in accordance with the method described hereinabove and examined the same under a scanning electron microscope to observe the clip coating-polyethersulfone connector body interface. We did not find any interface between the copper body of the clip and the plastic. Thus, apparently, the epoxy resin coating 18 on the clip becomes dissolved or saturates into the plastic body. The epoxy coating on the clips seals the micro cracks in the plastic body of the connector as evidenced by the fact that under voltage withstanding (breakdown) tests of 1500 volts, connectors made in accordance with the present invention had far fewer failures than the prior art connectors which incorporated uncoated clips. For example, in two groups of 15 similar connectors containing coated and uncoated clips, respectively, there was only one failure out of 14 for the connectors manufactured in accordance with the present invention, and 7 failures for the connectors incorporating the uncoated clip. In another test on one group of 39 connectors using coated clips and on a second group of 32 similar connectors but using uncoated clips, there were no failures in the first group but one failure in the second group. In a further test on 34 connectors embodying coated clips, there was just one failure. In another test on 37 connectors containing uncoated clips, there were 18 failures.

We have conducted silver electroplating studies on the resin coated contact retention clips (prior to insertion in an insulator) and found that the coatings contain large amounts of micropores as evidenced by silver plated nodules on the coated clips. Yet, after insertion of the clips in the insulator and cross-linking of the resin coating by heating, an effective seal is achieved. This indicates that it is the clip insertion heating which causes the boundry seal to be produced between the metal clip body 14 and the insulator 28, and not the fact that the clip itself is insulated with the resin coating.

We have found that the contact retention clips may be installed in the plastic connector body, in accordance with the present invention, between 200° F. to 300° F. lower in temperature than has been possible without the coating. Because of the reduced temperature, less strain is imparted into the contact retention tines 14 of the clip, thereby reducing the possibility of the tines cracking and, hence, failure under high push-out forces. Further, there is less chance of deformation of the insulator.

The invention certainly is not limited to the specific plastic body and resinous coating material described hereinabove. For example, we have utilized with some success contact retention clips coated with EC-2290 epoxy resin in insulators molded of PX6561 alloy of polysulfone and polyester marketed by Union Carbide, and contact retention clips coated with 5961B resin marketed by W. R. Grace in PX6561 insulators. The Grace 5961B resin is believed to be a polyacrylic resin that has been UV sensitized with a mercapton activator.

Obviously, the choice of the resin will depend upon the composition of the plastic connector insulator. By way of additional examples, polyarylsulfones and polyoxyarylsulfones are thermoplastic resins which we believe may be used as the connector insulator. By way of further example, if the connector insulator were formed of a polyphenylene sulfide resin, a 4,4'-thyodiphenyl modified epoxy resin could be utilized as the resinous coating for the contact retention clip.

Further, the invention is not limited to heat staked contact retention clips having barbs thereon. It is believed that the invention could be practiced with the same advantageous results utilizing standard contact retention clips, without barbs, by coating the clips with a resinous material which is compatible with the connector insulator, inserting the clips into the contact cavities in the insulator, and thereafter applying sufficient heat to the assembly to cause the resinous coating to interdiffuse with the insulator.

Thus, the present invention provides a solution to the problem of micro cracks, and voltage breakdowns, which occasionally occur in connectors having very closely spaced contact cavities. Furthermore, the method results in a contact retention assembly that has less possibility of cracking of the contact retention tines.

What is claimed is:

1. A method of making an electrical connector assembly comprising the steps of:

providing a plastic body having a bore therein;

providing a contact retention clip having a resinous coating thereon, said plastic body and resinous coating have a chemical substituent in common;

inserting said clip in said bore; and heating said coating on said clip to cause any cracks which may exist in said plastic body to become sealed by the coating.

2. The method according to claim 1 wherein: said coating is heated by heating said clip.

3. The method according to claim 2 wherein:

said clip is provided with a plurality of discontinuities therearound;

the portion of said plastic body surrounding said bore is softened by the heating of said clip; and said clip is expanded in said bore while heated to cause said discontinuities to be seized by said softened body portion.

4. The method according to claim 1 wherein:

said chemical substituent is a sulfur containing radical.

5. The method according to claim 1 wherein:

said resinous coating is an epoxy resin.

6. The method according to claim 5 wherein:

said plastic body is a polyethersulfone; and said epoxy resin is a sulfone modified epoxy system.

7. The method according to claim 1 wherein:

said coating on said clip is a B-stage epoxy resin.

8. The method according to claim 1 wherein:

said plastic body is a polyethersulfone; and said resinous coating is a B-stage sulfone modified epoxy system.

9. A contact retention clip adapted to be mounted in a bore in a plastic body comprising:

a hollow metallic body having an inwardly extending resilient contact retention tine thereon; and a resinous coating on said metallic body containing a chemical substituent in common with a chemical constituent in the plastic body.

* * * * *